United States Patent [19]

Hull

[11] Patent Number: 5,074,097

[45] Date of Patent: Dec. 24, 1991

[54] MEANS FOR REMOVING TOPS OF BOXES

[75] Inventor: Kent D. Hull, Colbert, Wash.

[73] Assignee: Hullpak Manufacturing, Inc., Spokane, Wash.

[21] Appl. No.: 408,256

[22] Filed: Sep. 18, 1989

[51] Int. Cl.[5] ..... B65B 43/26

[52] U.S. Cl. ..... 53/381.2; 53/381.4; 414/412; 83/177

[58] Field of Search ..... 53/381 A, 381 R, 492, 53/381.2, 381.4; 83/53, 177; 414/412; 198/626.1, 692

[56] References Cited

U.S. PATENT DOCUMENTS

| | | | |
|---|---|---|---|
| 2,683,560 | 7/1954 | Keller | 53/381 A |
| 2,729,885 | 1/1956 | Wahl et al. | 53/381 A |
| 3,263,843 | 8/1966 | Grahn et al. | 414/412 |
| 3,394,827 | 7/1968 | Shorthouse | 414/412 |
| 3,777,445 | 12/1973 | Anderson | 53/381 R X |
| 3,777,455 | 12/1973 | Allen | 53/381 A |
| 3,889,442 | 6/1975 | Grahn et al. | 53/492 |
| 4,165,811 | 8/1979 | Mainville | 414/412 |
| 4,182,170 | 1/1980 | Grupp | 83/177 |
| 4,592,698 | 6/1986 | Semp et al. | 83/177 X |
| 4,622,875 | 11/1986 | Emery et al. | 83/177 X |

*Primary Examiner*—John Sipos
*Assistant Examiner*—Linda B. Johnson
*Attorney, Agent, or Firm*—Jensen & Puntigam

[57] ABSTRACT

A device for removing covers from corrugated paperboard boxes including stations for cutting the sides and ends of the boxes (8,24) through the use of water jets (62) shielded by a dissipater (76) when not in use and then physically removing the severed top at station (42) by impaling it upon spikes (138) mounted to chains (116,120) and moving the severed top in a direction different from the main box.

3 Claims, 5 Drawing Sheets

MEANS FOR REMOVING TOPS OF BOXES

DESCRIPTION

1. Technical Field

This invention relates to a mechanism for automatically removing the tops of corrugated paperboard boxes or the like without damaging the contents, and more particularly, to a device which cuts through the four sides of a corrugated paperboard box and then removes the top while leaving the contents, and specifically, deals with the cutting nozzle mechanism for severing the top of the box and apparatus for removing the tops of the boxes once they are severed.

2. Background Art

In jurisdictions where it is required by statute that bottles be recycled an increased cost of handling, during the recycling process, exists in the removal of the bottles from the containers in which they are stored and/or collected prior to recycling. Machines exist that will automatically lift and scrub bottles or the like for reuse, however, these machines in general need access to the tops and/or necks of the bottles.

Oftentimes the recycling process includes bottles that are stored in containers that have been bent, torn, or wet and/or have had their upper, normally-open end closed. It is therefore desirable to have a device which will consistently remove the tops of the boxes, no matter what the physical condition such that the necks and tops of the bottles are exposed to the automatic bottle-handling mechanism. Since the personnel used to accomplish the recycling cannot be relied upon for critical judgments, the mechanism must be largely foolproof.

It is necessary, of course, to have the mechanism which prepares the boxes and their contents for automatic removal be such that it does not damage the contents and therefore mechanical cutting mechanisms such as knives or saws are precluded and a device utilizing a pressurized jet of water is utilized. The use of a pressurized jet, since it has great reach and if powerful enough to cut corrugated paperboard will also damage tissue, also creates a problem.

Prior art devices which disclose the utilization of a water jet to cut material include U.S. Pat. No. 3,927,591 granted to Gerber on Dec. 23, 1975 which discloses a bed for cutting sheet material by a high velocity cutting jet and in particular the bed includes a means to diffuse the water jet following the cut or between cuts.

U.S. Pat. No. 3,978,748 granted to Leslie et al Sept. 7, 1976 discloses a fluid jet cutting system and includes a catcher which automatically receives the fluid from the jet following the cut and withdraws the fluid and any entrained debris. The catcher is always placed within its jet stream.

U.S. Pat. No. 4,182,170 granted to Grupp Jan. 8, 1930 discloses both a single nozzle and a pair of nozzles which are adapted to move permitting the jets to jut a straight line across a longitudinally moving fiber web.

U.S. Pat. No. 4,435,902 granted to Mercer et al Mar. 13, 1984 discloses a fluid jet cutter mounted on an articulated boom and includes a catcher for removing the cutting debris and waste fluid. The catcher moves with the nozzle.

U.S. Pat. No. 4,592,698 granted to Semp et al June 3, 1986 discloses a water knife to cut the covering material from tobacco bales. The knife is moved into position, the bale rotated in front of the knife and the knife then removed to allow further processing.

U.S. Pat. No. 4,620,466 granted to Jumel et al Nov. 4, 1986 discloses a cutting machine wherein material is moved along a belt and a fluid cutter is likewise moved along the belt while cutting the material, the cutter includes a catcher mechanism as seen in FIG. 3.

DISCLOSURE OF THE INVENTION

With the above-noted prior art and problems in mind it is an object of the present invention to provide a mechanism which will effectively and consistently remove the tops of corrugated paperboard boxes and the like without damage to the contents. A mechanism which will handle boxes of various conditions including being topless.

It is another object of the present invention to provide a cutting device for removing the tops of corrugated paperboard boxes or the like wherein the cutting medium is fluid under pressure and the device includes a fluid pressure dissipater which dissipates the fluid from the nozzle when the nozzle is not cutting. The dissipater is automatically removed to permit cutting at the appropriate time, thus greatly reducing the danger of injury and as a noise abatement.

Yet another object of the present invention is to provide a mechanism for consistently gripping and removing the severed tops of corrugated paperboard boxes and the like.

Still a further object of the present invention is to provide a fully automated mechanism wherein a carton full of bottles or the like may be placed upon a conveyor at the front end of the mechanism and an open topped container will exit the back of the mechanism.

Still a further object of the present invention is to provide a lid-removing mechanism wherein a severed box lid, no matter what the condition, will be gripped and physically removed from the remaining box.

Yet another object of the present invention is to provide a mechanism above and along the side of the box carrying conveyor which impales the lid of the box and removes it as the box is moved along the conveyor.

DETAILED DESCRIPTION OF THE DRAWINGS

Figure 1:
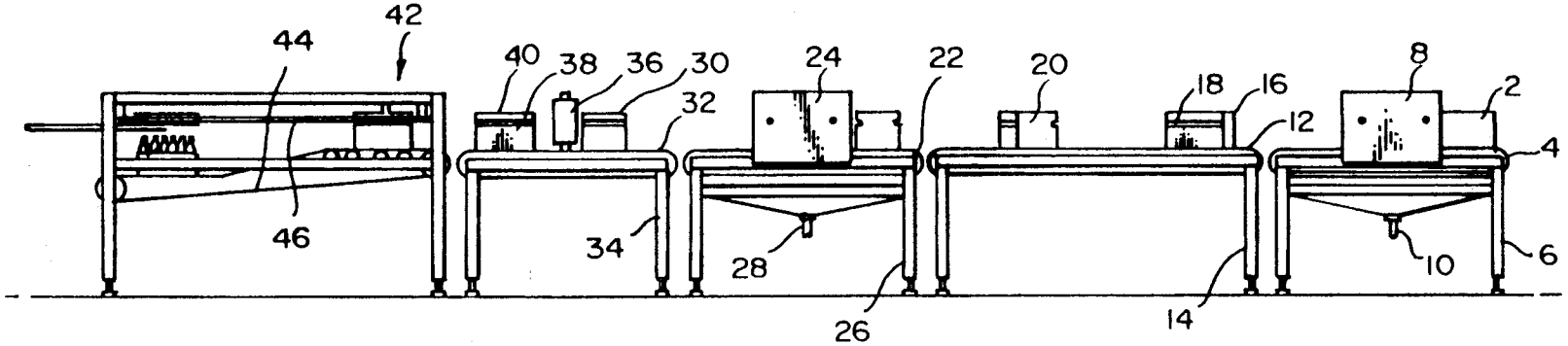
FIG. 1 is an elevational view of the production line including stations for severing and removing the tops or corrugated paperboard containers.

As seen in FIG. 1, the process of removing a lid from a corrugated paperboard container containing beer bottles or the like without damaging the contents utilizing the present invention includes several contiguous stations The container 2 is placed upon a conveyor belt 4 which is supported by a stand or the like 6 and is moved through the cutting device 8 where the container is horizontally sliced along opposite sides by a jet of water, it is to be noted that the station includes a drain 10. Following the first cut at station 8 the container is moved forwardly onto conveyor 12 supported by a stand 14 and as seen the container 16 has been sliced along its longitudinal side as at 18 and is rotated through 90° as at 20. The container is moved forward by conveyor 22 to a second cutting station 24 supported by a table 26 and including a drain 28. Following the second horizontal cut along opposing sides the carton 30 is again rotated through 90° on belt 32 supported by table 34. The rotation at this time is caused by contact with a bumper 36. The carton 38 with top 40 completely severed now moves to the lid removal station 42, which as explained hereinafter, includes a bottle case conveyor ramp 44 which is lower at the outgoing end than at the incoming end and a lid impaling and carrying device 46 that carries the lid away as the case drops to a lower position.

Figure 2:
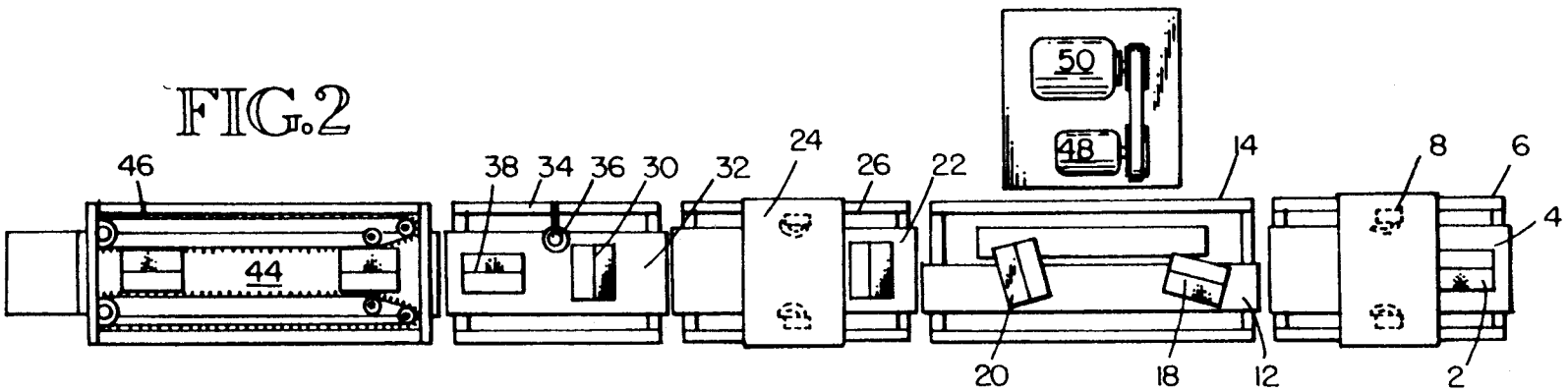
FIG. 2 is a top plan view of the line of FIG. 1.

Reference is now had to FIG. 2 wherein the entire line is shown in a plan 2 view, utilizing identical part numbers as FIG. 1.

In addition to the elements described herein above with respect to FIG. 1 there is also shown in this view (FIG. 2) an electric motor 48 driving pump 50 such that water from the standard water line can be used and the pressure is increased to give it sufficient energy to sever the carton.

Figure 3:
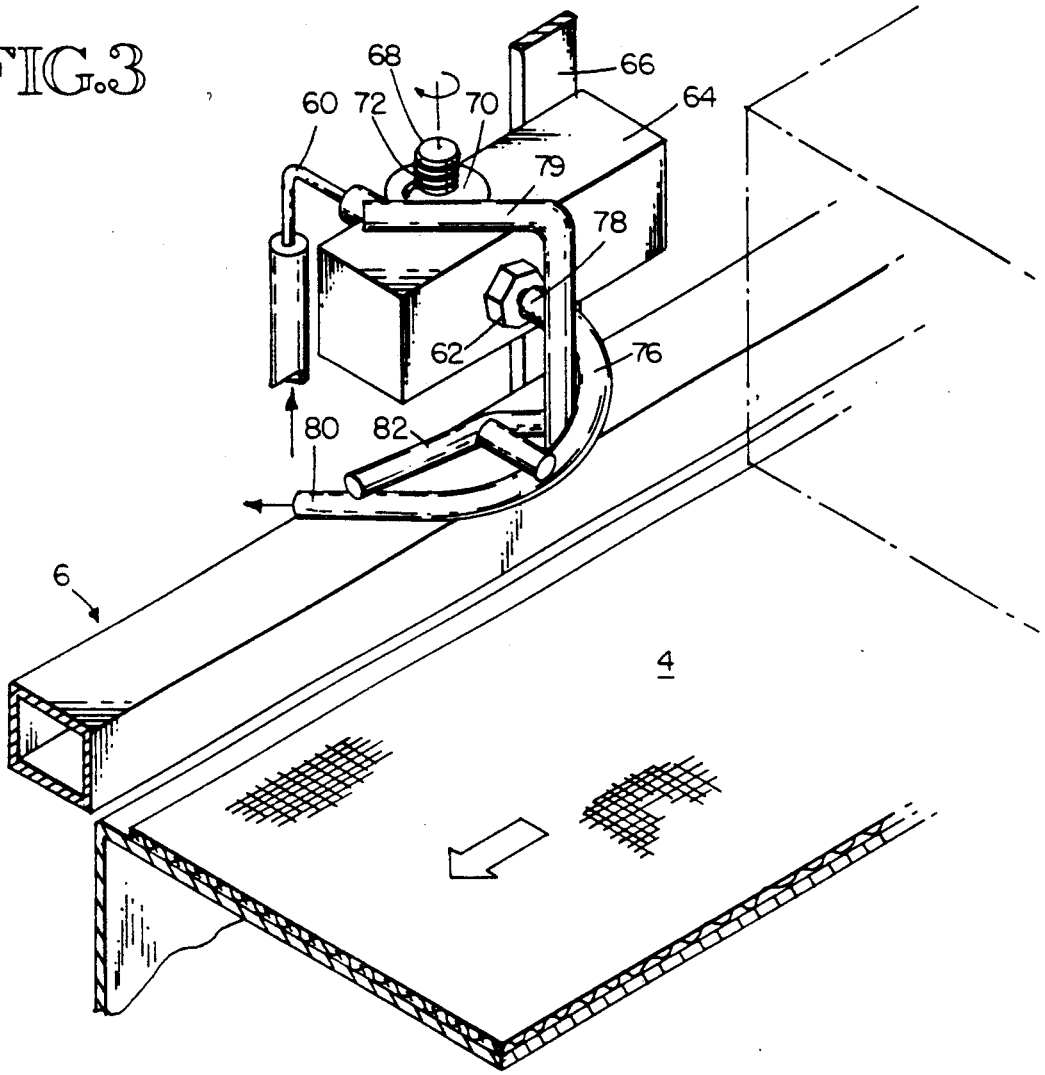
FIG. 3 is an enlarged perspective view of the cutting nozzle with the safety deflector or flow dissipater in place.
Figure 4:
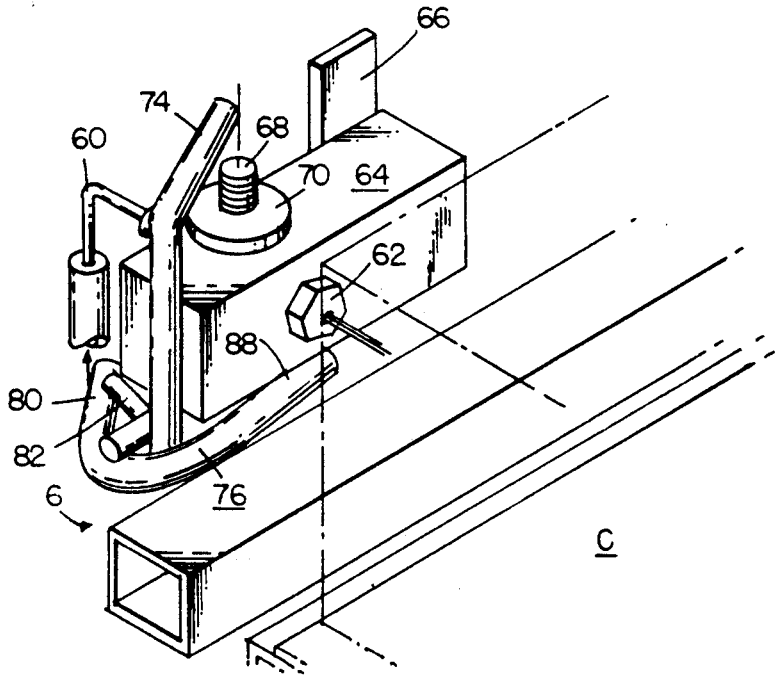
FIG. 4 is a view similar to FIG. 3 with the jet deflector moved to an inoperational position allowing the nozzle to cut the side of a corrugated paperboard box moving in front of the nozzle.

Referring now to FIGS. 3 and 4 an enlarged perspective view is shown of the cutting jet itself as well as a means for greatly reducing or eliminating the risk of injury. As seen in these views the carton C, shown in phantom, moves along belt 4 being supported and guided by the table framework generally designated as 6. Mounted at a position adjacent to the belt 4 is the nozzle system which includes an intake pipe 60 which feeds through a nozzle member 62 encased in a manifold block 64 rigidly secured to a vertical bar 66 which is in turn bolted or otherwise secured to the framework 6. Likewise mounted to the manifold block is an upwardly projecting rod 68 having mounted thereupon a mounting disk 70 which is biased in a counter-clockwise position by spring 72. Rigidly secured to mounting disk 70 is a mounting arm 74 which extends substantially horizontally to a point above the belt 4 and then downwardly where it has secured thereto a curved tube member 76 which extends from a first position adjacent and overlying the nozzle opening in nozzle member 62 and a second position which is spaced therefrom The tube between the entry and terminating position is curved such that the fluid under pressure which enters end 78 is exited from end 80 with very little force since the curvature of the tube absorbs some of the energy and because the size of the tube allows the water which was discharged from the nozzle in a needle stream to be diffused. It is to be noted that a brace member 82 is connected to the lower portion of arm 74 and is likewise secured to tube 76 to maintain rigidity.

As seen in FIG. 4 as the carton C moves on the belt 4 the corner of the carton contacts the tube 76 causing it to react against spring 72 moving it to a position away from nozzle 62 allowing nozzle 62 to stream water under pressure against the side of the carton cutting the corrugated paperboard.

Thus as can be seen the nozzle and the stream therefrom are shielded at all times except when a carton C has moved the diffuser tube 76 from in front of the nozzle. Diffuser tube 76 only allows the nozzle to be open when a carton C is in front of the nozzle. It is to be understood that the present invention contemplates a nozzle of this type on either side of the carton such that both parallel sides will be simultaneously cut and then as explained hereinabove the carton is turned through 90° and the end panels are then cut. It is further to be understood that the particular order of the sequence, i.e. side panel and end panel cut is not critical only that the panels be cut and that the water under high pressure be effectively dissipated when the cutting process is not in operation.

Figure 5:
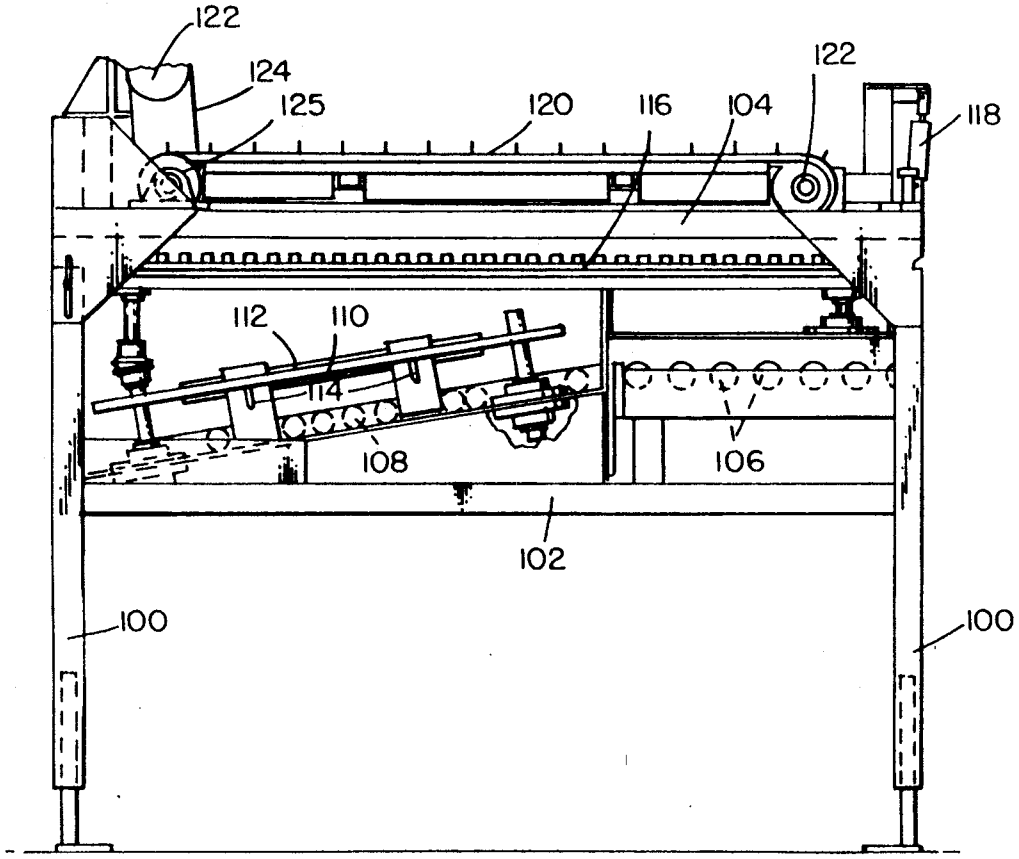
FIG. 5 is a side elevational view of the lid remover.

Reference is now had to FIG. 5, which is a side elevational view of the device for removing the previously severed top to the container. As seen in this view the device comprises a lower support portion and an upper movable portion Both of these portions are supported on a framework consisting of legs 100 and horizontal frame members 102, 104 and also include protective shielding which has been removed for the purposes of the present disclosure. The lower portion of the device includes a plurality of horizontal rollers 106 to support a corrugated paperboard container which has had its top severed. To the left of the rollers 106 is a downwardly inclined roller conveyor 108 having mounted thereabove a pair of opposing driven belts 110 mounted adjacent to belt guide 112 supported by brackets 114 to urge the container which is now topless out of the machine at a controlled rate.

Likewise mounted in the lower portion of the machine for rotation about a vertical axis are a pair of opposing chains 116, described in greater detail hereinafter, formed in a loop and placed upon opposite sides of rollers 106 and extending over and above the ramp 108.

Referring now to the upper portion of the machine it can be seen that portion 104 is able to be pivoted upwardly and away from the lower portion by means of hydraulic ram 118. The upper portion includes a pair of parallel chains 120 mounted upon horizontal axis 122 moving in the same direction as the corrugated paperboard container. Likewise as seen in the upper portion of the figure an electric motor 122 drives chain 124 which engages a sprocket, not seen in this view, which in turn drives chains 116, 120 and belt 110 as explained hereinafter.

Figure 6:
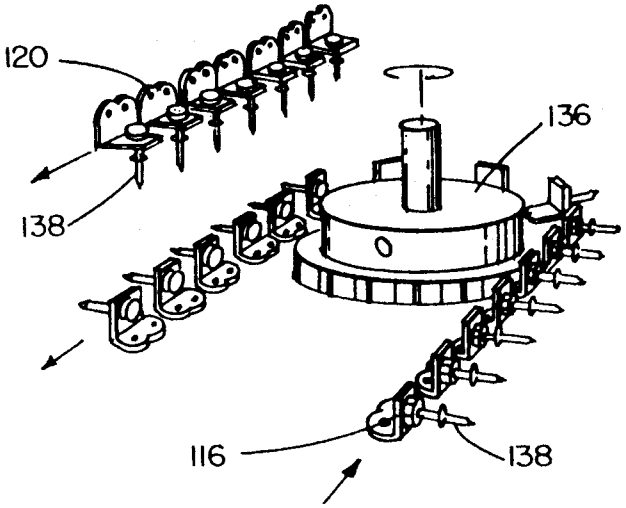
FIG. 6 is an enlarged view of the lid removing mechanism.
Figure 7:
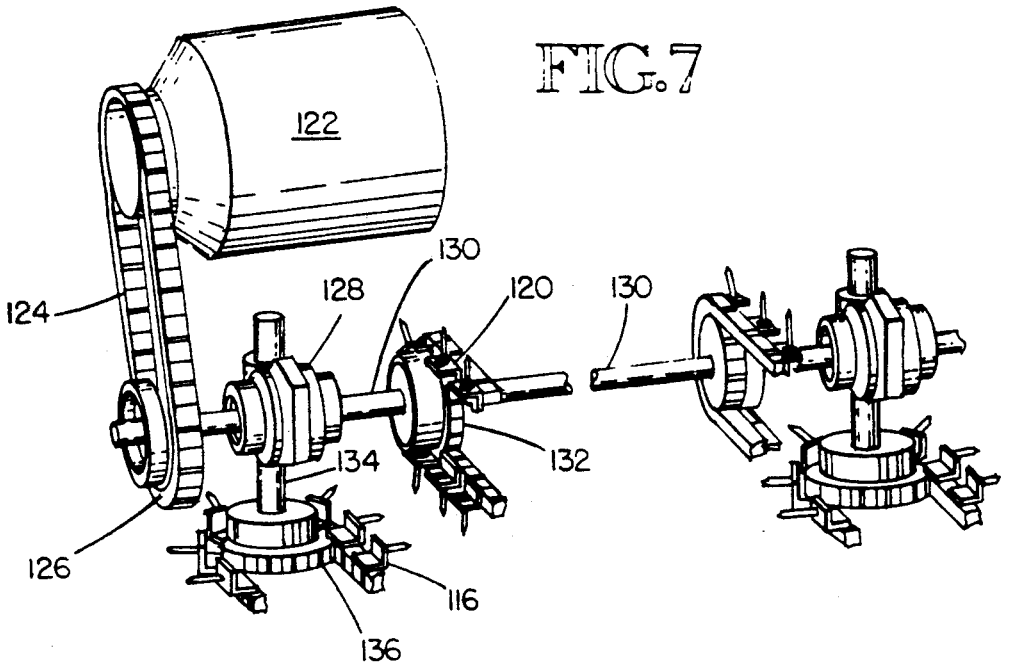
FIG. 7 is an isolated view of the drive mechanism.

Attention is now directed to FIGS. 6 and 7 wherein the interrelationship between the various chains and drive mechanisms may more easily be seen. Motor 122 drives chain 124 interconnected with sprocket 126 mounted upon a horizontal shaft which in turn drives gearubox 128 which has a horizontal shaft 130, which drives sprocket 132 upon which is mounted chain 120 (one of a pair) and a vertical shaft 134 which drives sprocket 136 upon which chain 116 (one of a pair) is mounted. Also seen in this view, shaft 130 extends horizontally across the machine and drives the second vertically disposed chain 120, enters a gearbox similar to 128 which drives a horizontal shaft which in turn drives horizontally disposed opposing chain 116.

FIG. 6 discloses a representative sprocket 136 driving chain 116 which is a link chain having a spike 134 extending outwardly from each link. The vertical chain 120 of similar construction can also be seen in this view. The carton with its lid now severed passes on a belt adjacent to and below the opposing chains 116 and directly below the two vertical chains 120 causing the spikes 134 and 136 to penetrate the carton top and impale it as the carton moves through the machine.

Once the carton reaches the end of the rollers 106 it moves vertically away from the chains moving down roller conveyor 108 whereas the lid is impaled upon the spikes of chains 116, 120 and stays at the same level separating the two units.

Figure 8:
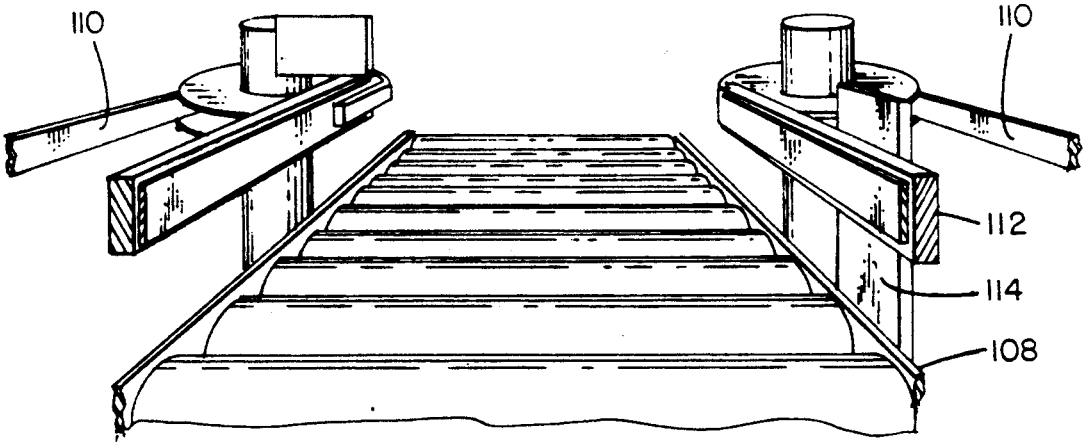
FIG. 8 is an end view of the exit from the top remover station.

As seen in FIG. 8, a pair of opposed belts 110 running parallel to and above roller conveyor 108 contact the sides of the container and control the rate of descent. As seen in FIG. 5, the belts 110 are driven by motor 122.

Figure 9:
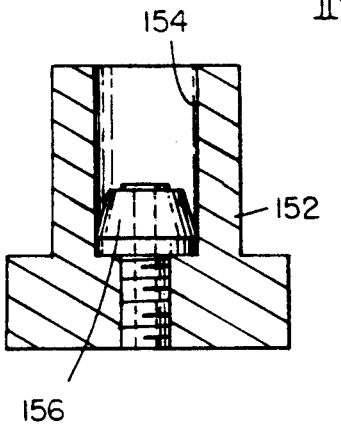
FIG. 9 is a sectional view of a single nozzle.
Figure 10:
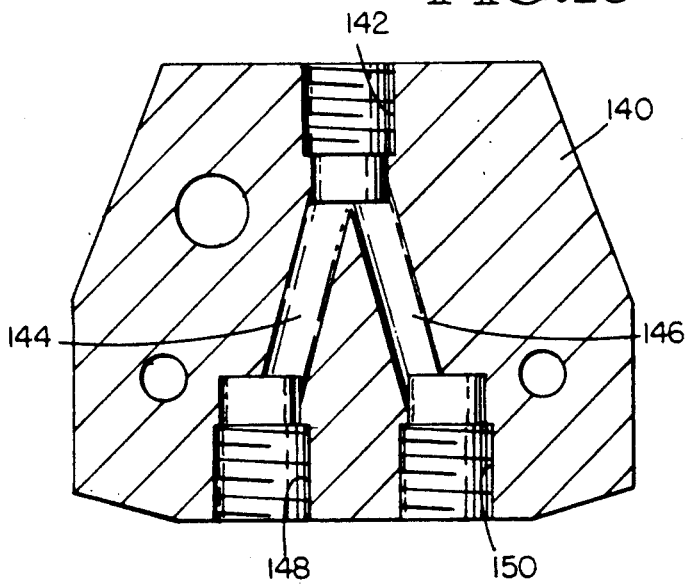
FIG. 10 is a sectional view of the housing or manifold for a double nozzle.

Reference is now had to FIGS. 9 and 10 which together disclose the nozzle assembly. Basically the nozzle assembly includes a housing or manifold 140 including at least one internal bore as at 142 to accept a fluid pressure fixture and then forwardly extending bores 144, 146 terminating in a pair of bores 148, 150 into which is pressed a plug 152 (see FIG. 7) which has a bore 154 and a nozzle 156 pressed therein. It is to be understood that the nozzles may be used collectively as a double nozzle or as single nozzle, depending of course, on the boxes which are expected to be cut.

Thus as can be seen, the present invention quickly and efficiently removes the tops of containers, whether they have been soaked, torn, dented or otherwise disfigured, completely and consistently by first severing the upper portion of the box by cutting same with a water jet, thus not damaging contents and then impaling the top upon moving spikes allowing the box to move away from the impaled top by descending upon an inclined ramp.

I claim:

1. A device for automatically removing the tops of boxes containing fragile items even if the box is damaged or wet comprising:

means operable only when a box is presented to sever the top from the remainder of the box without contacting the box or damaging the contents, conveyor means to move the box past the severing means, means for removing the severed top of the box comprising a plurality of pointed elements adjacent to but above the conveyor means, means for moving said plurality of pointed elements in a direction parallel to said conveyor means for penetrating and removing the severed top of the box while the box is moving on said conveyor means.

2. A device as in claim 1 wherein there are four chains containing the pointed element, two adjacent to the side and running parallel to the conveyor to contact the sides of the box and two adjacent parallel to the conveyor and above to impinge the severed top.

3. Means for removing the top of cartons comprising:

conveyor means for carrying the carton through a plurality of work stations whereat the top of the container is severed and removed, a plurality of nozzles directing water under pressure for severing the top of the carton, said nozzles including integral means for deflecting the water when not cutting a carton, means downstream of the cutting means to impale the severed top and remove it from the carton comprising:

a plurality of pointed elements moving in the same direction as the conveyor means extending outwardly a distance sufficient to penetrate the severed top as the carton moves along the conveyor means.

* * * * *